US007731910B2

(12) United States Patent
Boyd et al.

(10) Patent No.: US 7,731,910 B2
(45) Date of Patent: Jun. 8, 2010

(54) MICROFLUIDIC MIXING ASSEMBLY

(75) Inventors: Patrick V. Boyd, Albany, OR (US); Philip Harding, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 983 days.

(21) Appl. No.: 11/198,670

(22) Filed: Aug. 5, 2005

(65) Prior Publication Data

US 2007/0028969 A1 Feb. 8, 2007

(51) Int. Cl.
*B01L 3/00* (2006.01)
*B01F 13/00* (2006.01)
*B01F 15/02* (2006.01)

(52) U.S. Cl. ..... 422/103; 422/100; 422/102; 436/180; 137/806; 137/825; 137/833

(58) Field of Classification Search ..... 422/102, 422/103, 68.1, 99; 137/825, 606
See application file for complete search history.

(56) References Cited

U.S. PATENT DOCUMENTS 6,143,248 A * 11/2000 Kellogg et al. ..... 422/72
6,743,399 B1 * 6/2004 Weigl et al. ..... 422/102
2001/0027745 A1 10/2001 Weigl et al.
2001/0055812 A1 12/2001 Mian et al.
2003/0175990 A1 9/2003 Hayenga et al.
2003/0232403 A1 12/2003 Kellogg et al.
2004/0191124 A1 9/2004 Noetzel et al.
2004/0191125 A1 9/2004 Kellogg et al.
2004/0203136 A1 10/2004 Kellogg et al.
2004/0206408 A1 * 10/2004 Peters et al. ..... 137/825
2005/0045479 A1 3/2005 Weigl et al.
2005/0083781 A1 4/2005 Caren et al.
2005/0133101 A1 * 6/2005 Chung et al. ..... 137/833
2005/0136545 A1 6/2005 Schmid et al.

* cited by examiner

*Primary Examiner*—P. Kathryn Wright

(57) ABSTRACT

A microfluidic mixing assembly includes at least first and second liquid sources, a microfluidic manifold, a first capillary valve between the first liquid source and the manifold, and a second capillary valve between the second liquid source and the manifold, wherein the first capillary valve is configured to open and provide a first liquid flow to the microfluidic manifold in response to an external force and the second capillary valves is configured to be opened by the first liquid flow.

18 Claims, 4 Drawing Sheets

MICROFLUIDIC MIXING ASSEMBLY

BACKGROUND

Recent trends in biomedical diagnostics and drug discovery suggest a rapid growth in the use of high-speed and high throughput chemical detection, screening, and compound synthesis. Several systems utilize expensive instruments that make use of large sample volumes and are difficult to transport. Efforts are being directed to accelerate drug delivery and therapeutics, contain high health care costs, and provide decentralized biomedical diagnostics, such as diagnostics for point of care and future technologies. Such efforts frequently focus on increased miniaturization, integration, and automation.

Micro-instrumentation that is based on integrating large parallel arrays of miniaturized fluid systems and sensors have been developed that reduce reagent volume and sample contamination. Such instrumentation may also provide faster and more efficient compounding and separations in biomedical and analytical applications. Tasks that are frequently performed in a series of bench-top instruments and chemical tests may be combined into a single portable unit.

In micro-fluidic systems, liquids are frequently passed through small channels and have relatively little inertia. In such an environment, viscous and capillary forces frequently dominate the flow patterns. Active valves or pumping equipment are frequently included in such micro-fluidic systems in order to ensure proper flow. Such active valves or pumping equipment on a micro scale may be relatively complicated and expensive to form.

SUMMARY

A microfluidic mixing assembly includes at least first and second liquid sources, a microfluidic manifold, a first capillary valve between the first liquid source and the manifold, and a second capillary valve between the second liquid source and the manifold, wherein the first capillary valve is configured to open and provide a first liquid flow to the microfluidic manifold in response to an external force and the second capillary valves is configured to be opened by the first liquid flow.

BRIEF DESCRIPTION OF THE DRAWINGS

The accompanying drawings illustrate various embodiments of the present apparatus and method and are a part of the specification. The illustrated embodiments are merely examples of the present apparatus and method and do not limit the scope of the disclosure.

Throughout the drawings, identical reference numbers designate similar, but not necessarily identical, elements.

DETAILED DESCRIPTION

This disclosure describes a microfluidic structure that includes a plurality of liquid sources, such as liquid reservoirs and associated capillary valves configured in a manifold such that the release of liquid from one valve results in the ensuing release of one or more other valves. According to one exemplary embodiment, the release of the ensuing valves is accomplished by the liquid front of the initially released liquid disrupting the meniscus of unreleased liquids and thereby inducing the release of those liquids as well.

The result of such an operation in a microfluidic environment may include providing co-laminar flow and enhanced mixing via short molecular diffusion path lengths. Such a configuration may also minimize the use of active valves and/or pumping equipment to flow and mix the fluids. These fluids may include a sample to be analyzed, such as a bodily fluid and reagents. Once combined, the mixed liquids may then be analyzed or advanced to another part of the microfluidic system.

In the following description, for purposes of explanation, numerous specific details are set forth in order to provide a thorough understanding of the present method and apparatus. It will be apparent, however, to one skilled in the art that the present method and apparatus may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Analysis System

Figure 1:
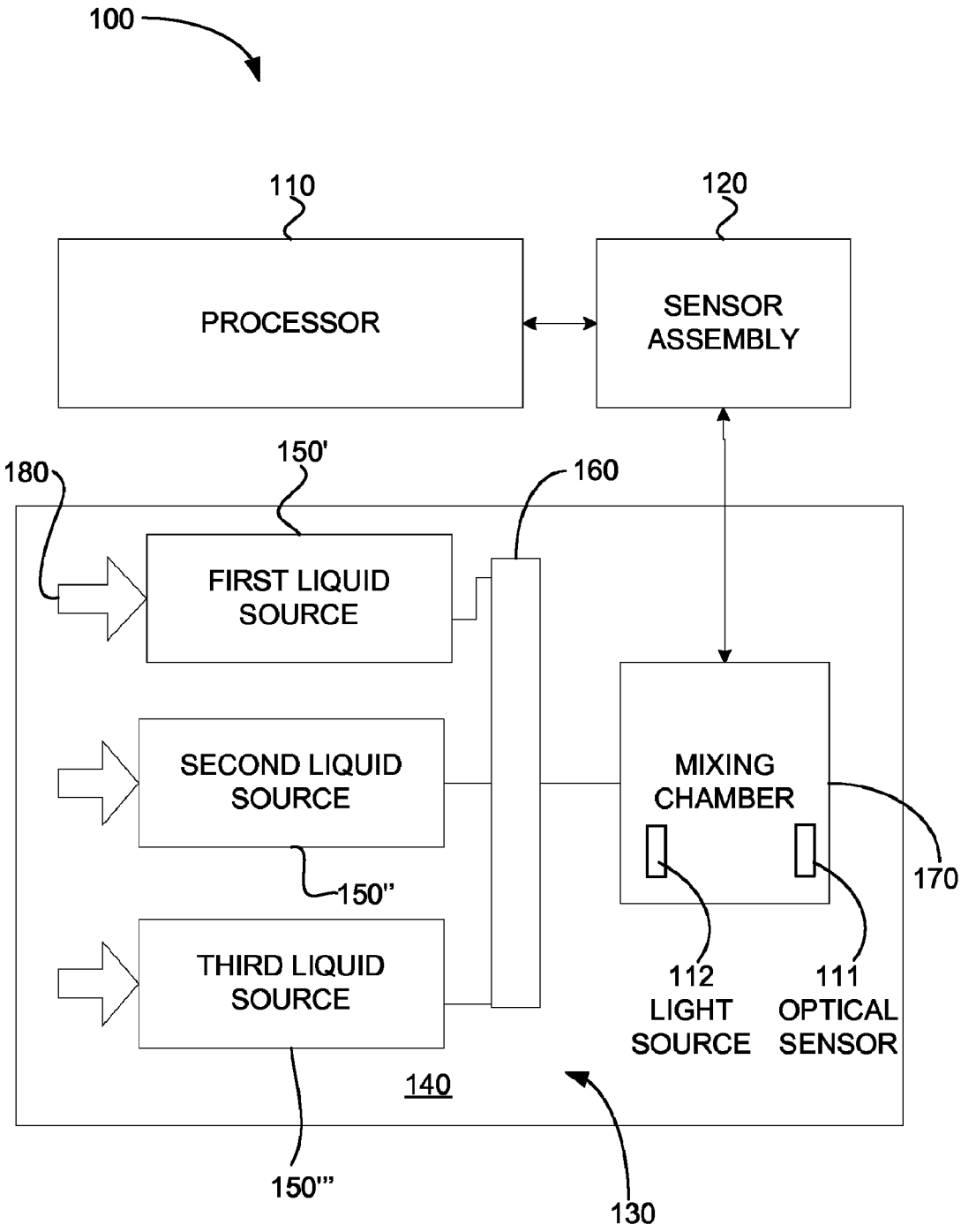
FIG. 1 illustrates a schematic view of a fluid analysis system, according to one exemplary embodiment.

FIG. 1 illustrates a schematic view of an exemplary analysis system (100) according to one exemplary embodiment. The analysis system (100) generally includes a processor (110), a sensor assembly (120), and a microfluidic mixing assembly (130). As will be discussed in more detail below, such a configuration may allow for nearly simultaneous mixing of multiple components while reducing the size of the sample and minimizing the use of active valves or pumping mechanisms in the microfluidic mixing assembly (130).

The microfluidic mixing assembly (130) generally includes a substrate (140), a plurality of liquid sources, such as first, second, and third liquid sources (150', 150", 150'") (collectively referred to as liquid sources), a manifold (160), and a mixing chamber (170) formed on the substrate (140). The liquid sources (150', 150", 150'") may be of a fixed volume, such as a reservoir, or they may have an indefinite volume, such as an inlet line or some combination of fixed volume and inlet lines.

The liquid sources (150' 150", 150'") are in liquid communication with the manifold (160), which in turn is in liquid communication with the mixing chamber (170). For example, the liquid sources (150', 150", 150'") are each coupled to a corresponding capillary valve.

According to one exemplary embodiment, each capillary valve resides at the outlet of a corresponding liquid source. As introduced, the liquid sources (150', 150", 150'") are each in liquid communication with the manifold (160). As such, a fluidic pathway is defined between each of the liquid sources (150', 150", 150'") and the manifold (160). Each capillary valve includes a region of increased width within the fluidic pathway.

Such a region of increased width may correspond to the outlet of a liquid source to the manifold (160). The increased width of the fluidic pathway causes the capillary forces to retain the liquid in the fluidic pathway, and thus disallow flow of liquid past the capillary valve without the application of some external force. The external force may correspond to a predetermined pumping force threshold or the inertial forces in a rotating platform. As a result, in the absence of a pumping force or in the presence of a pumping force below the predetermined threshold, the capillary valves disallow flow of liquid from the reservoirs (150', 150", 150'") to the manifold (160). Further, as introduced, each valve operates in response to forces rather than the use of moving parts. As such, the capillary valves are passive valves.

FIG. 1 also illustrates a depiction of the application of a pumping force (180). The pumping force (180) overcomes the capillary force in at least one of the capillary valves, thereby causing liquid to flow from at least one of the liquid sources (150', 150", 150") to the manifold (160). For ease of reference, the application of the pumping force (180) will be discussed as causing the first liquid source (150') to flow. The capillary valves of the other chambers are designed to require higher pumping forces to induce liquid release. Those of skill in the art will appreciate that any liquid source may be selected and/or more than one liquid source may be caused to flow.

The flow from the first liquid source disrupts the liquid menisci of the remaining capillary valves, thereby causing liquid to flow from the remaining liquid sources into the manifold (160). The now flowing liquid from the liquid sources (150', 150", 150'") flows from the manifold (160) to the mixing chamber (170). Thus, the microfluidic mixing assembly (130) is configured to flow and mix fluids substantially simultaneously while minimizing the use of active valves or pumping mechanisms.

The microfluidic mixing assembly (130) may be selectively coupled to the sensor assembly. In another embodiment, the fluid in the mixing assembly (130) may be mixed with another reagent and/or advanced to another chamber selectively coupled to the sensor assembly. The sensor assembly (120) senses characteristics of the liquid in the mixing chamber (170). In particular, according to one exemplary embodiment, the sensor assembly (120) includes a light source (112) and an optical sensor (111). Light from the light source (112) is directed to the mixed liquids in the mixing chamber (170). The sensor (111) may be an optical sensor configured to sense the light transmitted through, or reflected from, the mixed liquids. In another embodiment, the sensor may sense light fluoresced from the liquid in the mixing assembly.

The sensor assembly (120) transmits the sensed data to the processor (110). The processor (110) is configured to process this data and to analyze the characteristics of the liquid, which was mixed in the mixing chamber (170). The sensor (120) may be of any suitable type, including, without limitation, an optical sensor. The processor (110) may be of any suitable type, including without limitation, a computer, such as a personal computer or other type of computer. One exemplary method of analyzing a sample will now be discussed in more detail.

Method of Analyzing a Sample

Figure 2:
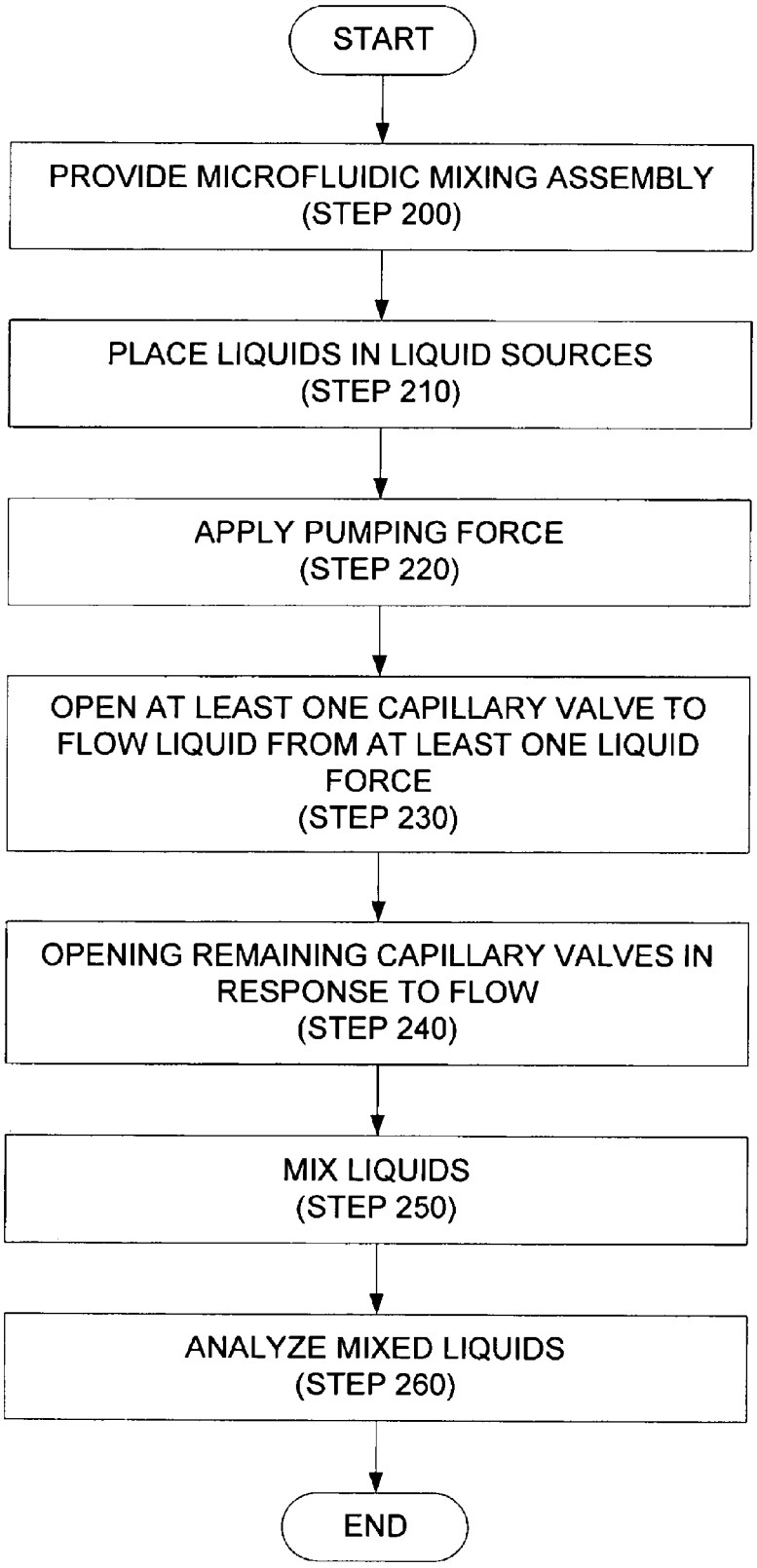
FIG. 2 is a flowchart illustrating a method of analyzing a fluid, according to one exemplary embodiment.

FIG. 2 is a flowchart illustrating a method of analyzing a sample according to one exemplary embodiment. The method begins by providing a microfluidic mixing assembly (130; FIG. 1) (step 200). For example, according to one exemplary method, providing a microfluidic mixing assembly (130) includes forming a plurality of liquid sources (150', 150", 150'") with corresponding capillary valves that are in communication with a manifold (160; FIG. 1) on a platform, such as a disc. This step may also include forming a mixing chamber (170; FIG. 1) in communication with the manifold (160; FIG. 1).

The present exemplary method also includes placing liquids in the liquid sources (step 210). The placement of the liquid in the liquid sources (150', 150", 150'") includes the placement of a liquid sample to be analyzed in a corresponding liquid source (150', 150", or 150'"). For example, this step may include the placement of a sample of bodily liquid, such as blood, urine, or other bodily liquid in one of the liquid sources (150', 150", or 150'"). Additionally, according to such an exemplary embodiment, the placement of liquids in the liquid sources includes placing at least one liquid reagent in at least one of the remaining liquid sources. This might occur during the manufacturing process. Suitable reagents may include, without limitation, chromophores, enzyme conjugates, catalysts, ion binding agents or other suitable reagents for use in analyzing a given sample.

With the liquids placed within the liquid sources (150', 150", 150'"), a pumping force is applied thereto (step 220). The magnitude of the pumping force is sufficient to overcome capillary forces and cause liquid to flow from the first liquid source (150') by opening at least one capillary valve, so as to flow liquid from at least one liquid source (step 230) and then others as previously described. The pumping force needed may depend on several factors, including, without limitation, the surface tension and viscosity of the liquids and the dimensions of the fluidic pathways. Pumping forces may include, without limitation, centripetal forces or pneumatic forces. For ease of reference, the application of a centripetal force will be discussed. Centripetal forces are applied by rotating the substrate or support about a rotational axis.

The magnitude of the centripetal force exerted on an object depends on several factors. These factors include, without limitation, the radial distance of the object from the rotational axis, the angular velocity of the object, and the characteristics of the liquids, such as the densities and volumes of the liquids. In particular, relatively larger radial distances, angular velocities, and densities result in the application of relatively larger centripetal forces on the object.

Further, the location and volumes of the liquid sources (150', 150", 150'") and angular velocity of the support may be selected, for example, to tune the resulting centripetal forces on the liquid sources (150', 150", 150'"). When the centripetal force exceeds the capillary forces in one or more of the capillary valves, liquid flows from the corresponding liquid source(s) (150', 150", 150'"). For ease of reference, flow from the liquid sources (150', 150", 150'") will be discussed with flow from the first liquid source (150') being provided in response to the applied centripetal force.

The flow from the first liquid source (150') flows into the manifold (160). As introduced, the manifold (160) is also in liquid communication with the second and third liquid sources (150", 150'"). The flow of liquid from the first liquid source (150') through the manifold (160) provides a disturbance to the liquid meniscii at the capillary valves associated with the other liquid sources, such as second and third liquid sources (150", 150'"), such that the flowing liquid from the first liquid source (150') comes into contact with the other liquids, thereby opening the remaining capillary valves (step 240).

As previously discussed, flow from the first liquid source (150') is induced by the application of the pumping force (180). Consequently, the disruption of the menisci in the other liquid sources induces a flow driven by the pumping force, such that liquid flows to the manifold (160) from all three liquid sources (150', 150", 150'") simultaneously.

The flow rate of liquid may also be controlled. As previously discussed, a microfluidic pathway is defined between each of the liquid sources (150', 150", 150'") and the manifold (160). Each microfluidic pathway may be characterized, in the case of cylindrical channels, by the radius of the channel (R) and the length of the channel (L). A channel of rectangular cross-section might be described by width (w), depth (d) and length (L). When subjected to a given external force field, the flowrate (Q) in the cylindrical channel may be approximated by the equation:

$$Q \sim R^4/L$$

Thus, by selecting the dimensions of the microfluidic pathway, the flowrate of each of the liquid sources (150', 150", 150'") may be selected as desired. For example, according to one exemplary embodiment, channels with dimension in the range of about 50 microns to about 1 mm in width may be selected with liquid sources with widths in the range of about 1 mm to about 10 mm. As the liquid flows to the manifold (160), the liquids are mixed (step 250). As the liquid is mixed, it flows from the manifold (160) to the mixing chamber (170) in response to the pumping force (180).

Once the liquid is mixed and is flowed to the mixing chamber (170), the mixed liquid, which may include a sample and reagents, is analyzed (step 260) In particular, according to one exemplary method, a sensor (120) senses the optical characteristics of the mixed liquid. In another embodiment, the fluid in the mixing assembly (130) may be mixed with another reagent and/or advanced to another chamber selectively coupled to the sensor assembly. This information is then conveyed to a processor (110), which analyzes the sample.

Accordingly, the present method provides for the substantially simultaneous mixing of liquids on a microfluidic platform while minimizing the use of active valves or pumping equipment on the platform. The mixing of liquids in such a manner may increase the speed with which one or more liquids on the microfluidic platform may be analyzed.

Microfluidic Mixing Assembly

Figure 3:
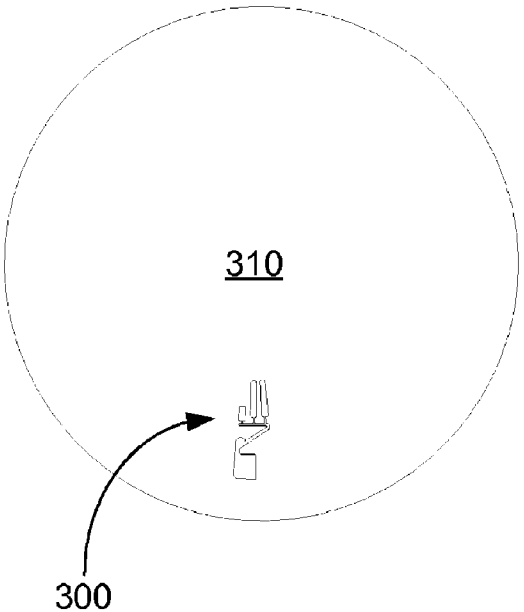
FIG. 3 illustrates a top view of a microfluidic mixing assembly formed on a disc according to one exemplary embodiment.

FIG. 3 illustrates a microfluidic mixing assembly (300) according to one exemplary embodiment. The microfluidic mixing assembly (300) is formed on a platform, such as a disc (310). For ease of reference, one microfluidic mixing assembly (300) is shown formed on the disc (310). Those of skill in the art will appreciate that any number of microfluidic mixing assemblies (300) may be formed on the disc (310).

Figure 4:
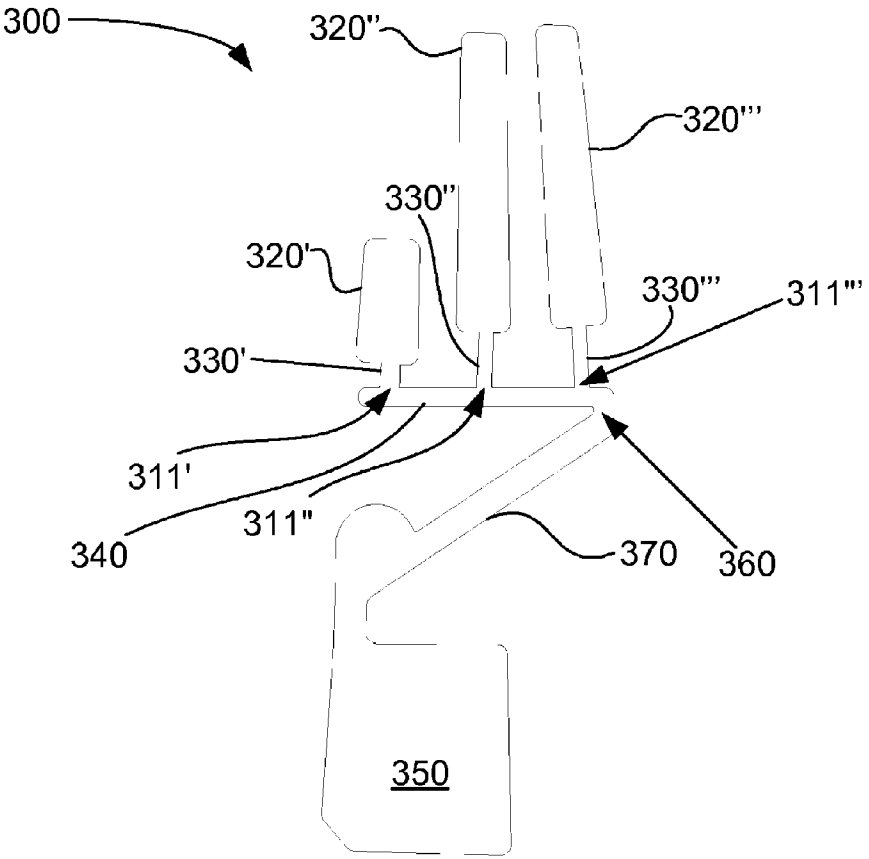
FIG. 4 illustrates a detailed view of the microfluidic mixing assembly of FIG. 3 according to one exemplary embodiment.

FIG. 4 illustrates the microfluidic mixing assembly (300) in more detail. The microfluidic mixing assembly (300) according to the present exemplary embodiment includes first, second and third reservoirs (320', 320", 320'"), first, second and third interconnect conduits (330', 330", 330'"), a microfluidic manifold (340), and a mixing chamber (350).

As will be discussed in more detail below, the flow and subsequent mixing of the liquid may be controlled passively, such as by application of an external force, thereby minimizing the use of active valves or other pumping mechanisms contained within the microfluidic mixing assembly (300).

As introduced, the microfluidic mixing assembly (300) is formed on a disc (310). The external force may be applied by rotating the disc (310) at an angular velocity, thereby creating a centripetal force on the microfluidic mixing assembly. As will be discussed in more detail below, the centripetal force causes the liquid to flow from the outlets of the first, second, and third interconnect conduits (330', 330", 330'").

The outlets of the first, second, and third interconnect conduits (330', 330", 330'") open into the microfluidic manifold (340). As such, a sudden increase in the width of the fluidic pathway occurs from the outlet of the interconnect conduits (330', 330", 330'") to the microfluidic manifold (340). As previously discussed, capillary valves frequently include a sudden increase in the width of the fluidic pathway. Thus, the outlets of the interconnect conduits (330', 330", 330'") act as capillary valves (311', 311", 311'") for the reservoirs (320', 320", 320'"). (330', 330", 330'") act as capillary valves for the reservoirs (320', 320", 320'").

As a result, the meniscii of the liquid from the first, second, and third reservoirs (320', 320", 320'") are at the outlets of the first, second, and third interconnect conduits (330', 330", 330'"). Each meniscus corresponds to the interface between the liquid in the interconnect conduits (330', 330", 330'") and gas in the manifold (340).

The capillary force at the outlet of the first interconnect pathway (330') is, by design and strategic selection of dimensions, relatively weaker than the capillary force at the outlets of the second and third interconnect conduits (330", 330'"). Thus, when subjected to an external force, liquid from the first reservoir (320') will flow into the microfluidic manifold (340).

The microfluidic manifold (340) includes an outlet (360). The outlet (360) is on the opposite end of the manifold (340) as the outlet of the first interconnect conduit (330'). As a result, liquid that enters the manifold (340) from the first interconnect conduit (330') flows past the second and third interconnect conduits (330", 330'") as the liquid flows toward the outlet (360) by the external force.

As the liquid flows past the second and third interconnect conduits (330", 330'"), the meniscus of the flowing liquid, or the liquid front, comes into contact first with the meniscus at the outlet of the second interconnect conduit (330") and then with the meniscus at the outlet of the third interconnect conduit (330'"). As the wave front comes into contact with each meniscus, a liquid/liquid interface is formed with the initially static liquid at the outlet and the moving liquid in the manifold.

The disturbance of each meniscus, adhesive forces between the mixing liquids at the liquid/liquid interface, the momentum associated with the flowing fluid from the first reservoir (320'), and the presence of an external force, among other factors, open the capillary valves and cause liquid to be drawn from the second and third interconnect conduits (330", 330'") into the microfluidic manifold (340). As the liquids are forced through the microfluidic manifold (340) and to the outlet (360), the liquids are mixed. The liquids then exit the manifold (340) through the outlet (360) and are directed through a mixing chamber conduit (370) to the mixing chamber (350).

Thus, the microfluidic mixing assembly (300) provides for substantially simultaneous flowing of liquids, such as a sample to be analyzed and reagents while minimizing the use of active valve and on-board pumping equipment. Further, those of skill in the art will appreciate that other configurations are possible.

Figure 5:
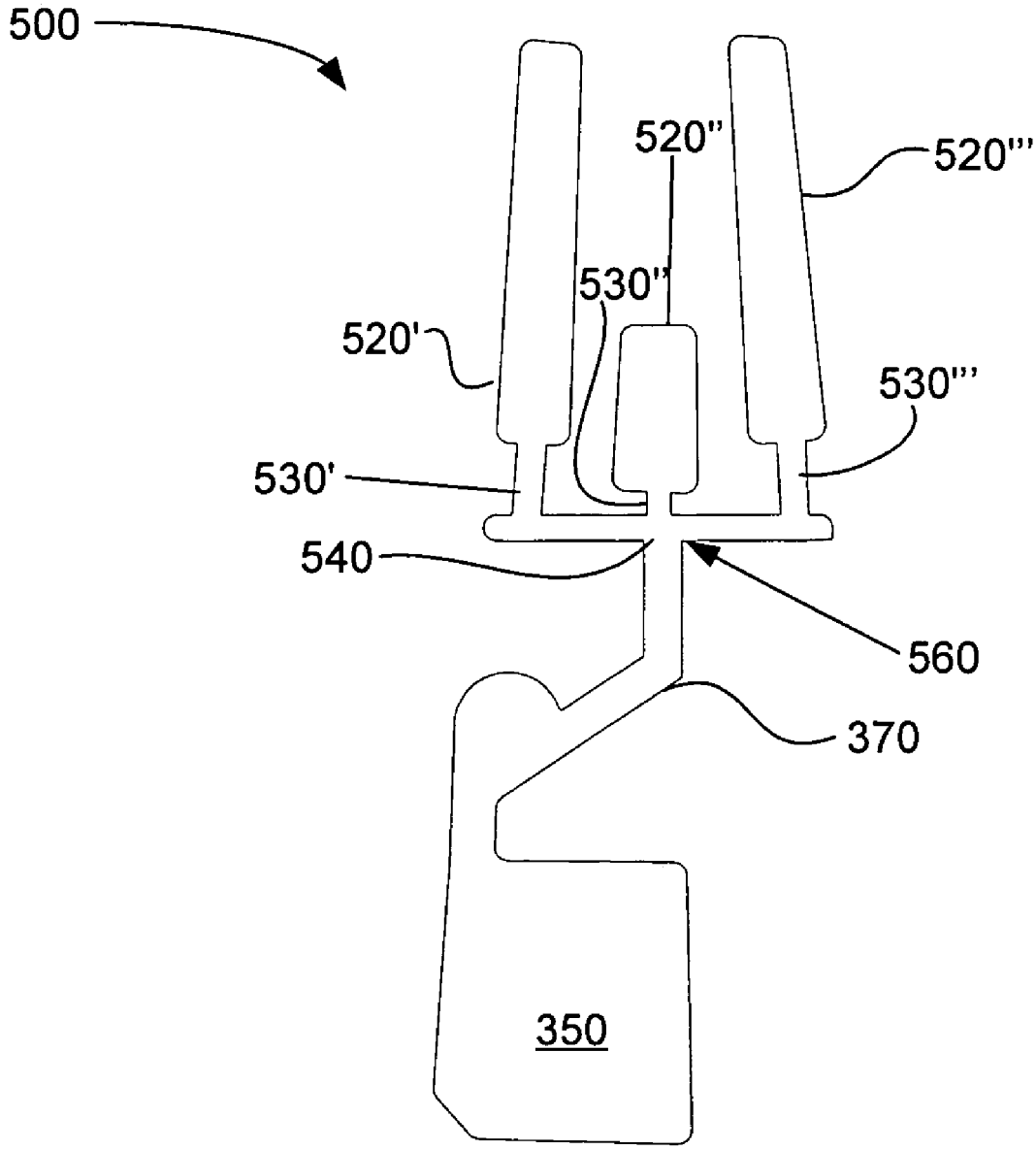
FIG. 5 illustrates a detailed view of a microfluidic mixing assembly according to one exemplary embodiment.

For example, FIG. 5 illustrates a detailed view of a microfluidic mixing assembly (500) according to one exemplary embodiment. As shown in FIG. 5, the microfluidic mixing assembly (500) includes first, second, and third reservoirs (520', 520", 520'") coupled to a microfluidic manifold (540) by first, second, and third interconnect conduits (530', 530", 530'"). According to such an exemplary embodiment, the outlets of the first and third interconnect conduit (530', 530")

are sized such that liquids flow at nearly the same time therefrom in response to an external force.

The liquids then flow toward a manifold outlet (560) defined in a central portion of the microfluidic manifold (540). As the liquids flow toward the manifold outlet (560), they flow past the second reservoir (520"), thereby causing liquid to flow from the second reservoir (520"), in a similar manner as discussed above. Thus, other configurations are possible whereby flow from one or more liquid sources induces flow from one or more remaining source.

In conclusion, a microfluidic structure has been discussed herein that includes a plurality of liquid sources, such as liquid reservoirs and associated capillary valves configured in a manifold such that the release of liquid from one valve results in the ensuing release of liquid from one or more other valves.

According to one exemplary embodiment, the release of the ensuing valves is accomplished by the liquid front of the initially released liquid disrupting the meniscii of unreleased liquids and thereby inducing the release of those liquids as well. The result in a microfluidic environment is co-laminar flow and enhanced mixing via short molecular diffusion path lengths. Such a configuration may minimize the use of active valving and/or pumping equipment to flow and mix the fluid. Fluids may include a sample to be analyzed, such as a bodily fluid, and reagents. Once combined, the mixed liquids may then be analyzed.

The preceding description has been presented only to illustrate and describe the present method and apparatus. It is not intended to be exhaustive or to limit the disclosure to any precise form disclosed. Many modifications and variations are possible in light of the above teaching. It is intended that the scope of the disclosure be defined by the following claims.

What is claimed is:

1. A microfluidic mixing assembly, comprising:

at least first and second liquid sources;

a microfluidic manifold;

a first capillary valve between said first liquid source and said manifold; and a second capillary valve between said second liquid source and said manifold, wherein said first capillary valve is configured to open and provide a first liquid flow to said microfluidic manifold in response to an external force and said second capillary valve is configured to be opened by said first liquid flow.

2. The assembly of claim 1, and further comprising a first interconnect conduit coupling said first liquid source and said microfluidic manifold and a second interconnect conduit coupling said second liquid source and said microfluidic manifold wherein said first capillary valve is defined at an outlet of said first interconnect conduit to said microfluidic manifold and said second capillary valve is defined at an outlet of said second interconnect conduit to said microfluidic manifold.

3. The assembly of claim 2, and further comprising a third liquid source, a third interconnect conduit coupling said third liquid source to said microfluidic manifold and a third capillary valve defined at an outlet of said third liquid source to said microfluidic manifold.

4. The assembly of claim 2, wherein said first and second interconnect conduits each have a width in the range of about 50 microns to about 1 mm.

5. The assembly of claim 2, wherein said first and second liquid sources each have a width in the range of about 1 mm to about 10 mm.

6. The assembly of claim 1, wherein said first and second liquid sources include at least one of a reservoir or a supply line.

7. The assembly of claim 1, wherein said microfluidic mixing assembly is formed on a substrate.

8. The assembly of claim 7, wherein said microfluidic assembly is formed on a disc.

9. The assembly of claim 1, and further comprising a mixing chamber in communication with said microfluidic manifold.

10. The assembly of claim 1, wherein said first capillary valve is configured to open in response to a centripetal, a pumping, a pneumatic force, or combinations thereof.

11. The assembly of claim 1, wherein said first and second liquid sources are sized and located to tune a centripetal force such that said assembly is rotated at an angular velocity and said centripetal force opens said first capillary valve without opening said second capillary valve.

12. The assembly of claim 1, further comprising:

a third liquid source, and a third capillary valve between said third liquid source and said manifold, wherein said third capillary valve is configured to be opened by said first liquid flow in response to opening of said first capillary valve.

13. The assembly of claim 12, wherein said first, second and third liquid sources are sized and located to tune a centripetal force such that said assembly is rotated at an angular velocity and said centripetal force opens said first capillary valve without opening said second or third capillary valves.

14. The assembly of claim 1, further comprising a mixing chamber fluidly connected to said manifold, wherein liquid from said liquid sources is mixed in said mixing chamber after opening of said first capillary valve.

15. The assembly of claim 14, further comprising a sensor assembly for sensing a characteristic of said liquid from said liquid sources mixed in said mixing chamber.

16. The assembly of claim 15, wherein said sensor assembly comprises a light source and optical sensor.

17. The assembly of claim 1, wherein said manifold directs said first liquid flow from said first capillary valve to said second capillary valve.

18. The assembly of claim 12, wherein said manifold directs said first liquid flow from said first capillary valve to said second and third capillary valves.

* * * * *

UNITED STATES PATENT AND TRADEMARK OFFICE

CERTIFICATE OF CORRECTION

PATENT NO. : 7,731,910 B2
APPLICATION NO. : 11/198670
DATED : June 8, 2010
INVENTOR(S) : Patrick V. Boyd et al.

It is certified that error appears in the above-identified patent and that said Letters Patent is hereby corrected as shown below:

In column 6, lines 10-11, after "320", 320'")." delete "(330', 330", 330'") act as capillary valves for the reservoirs (320', 320", 320'").".

Signed and Sealed this

Twenty-first Day of September, 2010

David J. Kappos

David J. Kappos
*Director of the United States Patent and Trademark Office*